US006067914A

United States Patent [19]

Hums et al.

[11] Patent Number: 6,067,914

[45] Date of Patent: May 30, 2000

[54] METHOD OF OPERATING A COMBUSTION UNIT OF A COAL-FIRED POWER PLANT WITH A SLAG TAP FURNACE AND COMBUSTION PLANT OPERATING ACCORDING TO THE METHOD

[75] Inventors: Erich Hums, Hessdorf; Horst Spielmann, Baiersdorf; Ralf Gilgen, Velbert, all of Germany

[73] Assignees: Siemens Aktiengesellschaft, Munich; STEAG Aktiengesellschaft, Essen, both of Germany

[21] Appl. No.: 09/040,970

[22] Filed: Mar. 18, 1998

Related U.S. Application Data

[63] Continuation of application No. PCT/DE96/01721, Sep. 12, 1996.

[30] Foreign Application Priority Data

Sep. 18, 1995 [DE] Germany ..... 195 34 558

[51] Int. Cl.[7] ..... C10L 10/00; F23J 1/00; F23J 3/00; F23B 7/00

[52] U.S. Cl. ..... 110/342; 110/204; 110/216; 110/344; 110/165 A; 44/603; 44/641; 44/905

[58] Field of Search ..... 110/341, 342, 110/343, 344, 345, 347, 203, 218, 261, 262, 263, 266, 204, 216, 165 A, 165 R; 75/435; 44/504, 603, 641, 905

[56] References Cited

U.S. PATENT DOCUMENTS

| | | | |
|---|---|---|---|
| 1,947,460 | 2/1934 | Coutant | 110/165 A |
| 4,057,398 | 11/1977 | Bennett et al. | 110/165 R X |
| 4,377,118 | 3/1983 | Sadowski | 110/343 |
| 4,388,877 | 6/1983 | Molayem et al. | 110/342 |
| 4,440,100 | 4/1984 | Michelfelder et al. | 110/343 |
| 4,577,566 | 3/1986 | Merrell | 110/343 |
| 4,771,712 | 9/1988 | Engstrom et al. | 110/347 |
| 4,782,772 | 11/1988 | Chughtai et al. | 110/345 |
| 4,836,117 | 6/1989 | Teller et al. | 110/342 |
| 4,843,980 | 7/1989 | Markham et al. | 110/342 |
| 4,979,447 | 12/1990 | Farrar | 110/345 |
| 5,001,994 | 3/1991 | Morimoto et al. | 110/342 |
| 5,309,850 | 5/1994 | Downs et al. | 110/235 |
| 5,819,672 | 10/1998 | Radway et al. | 110/344 |

FOREIGN PATENT DOCUMENTS

| | | |
|---|---|---|
| 0320036A1 | 6/1989 | European Pat. Off. . |
| 0324454A1 | 7/1989 | European Pat. Off. . |
| 1580577 | 9/1969 | France . |
| 2174958 | 10/1973 | France . |
| 3128903A1 | 3/1983 | Germany . |
| 4013720A1 | 10/1991 | Germany . |
| 4021362A1 | 1/1992 | Germany . |
| 4209166A1 | 9/1993 | Germany . |
| 44196816C1 | 6/1995 | Germany . |
| 253222 | 2/1948 | Switzerland . |

OTHER PUBLICATIONS

Published International Application No. 86/04525 (Koch), dated Aug. 14, 1986.

Japanese Patent Abstract No. 91–365154, dated Oct. 31, 1991.

*Primary Examiner*—Ira S. Lazarus
*Assistant Examiner*—Ljiljana V. Ciric
*Attorney, Agent, or Firm*—Herbert L. Lerner; Laurence A. Greenberg; Werner H. Stemer

[57] ABSTRACT

A method of operating a combustion unit of a coal-fired power plant operating according to a slag tap furnace firing method, which includes supplying a titanium-containing material in addition to coal to a melting chamber for accelerating coal burn-up, burning the titanium-containing material together with the coal in the melting chamber at a temperature above 1500° C., and generating fly ash and molten ash as a result of combustion in the melting chamber. Additionally, a combustion unit for a coal-fired power plant, including a melting chamber that has a combustion zone for receiving coal. The combustion zone produces fly ash. The combustion unit also includes a separate feed line for supplying a titanium-containing material to the combustion zone for accelerating burn-up of the coal and a second separate feed line first to supply a titanium-containing material to the fly ash and then supply the titanium-containing material and fly ash combination to the combustion zone for accelerating burn-up of the coal and fly ash.

11 Claims, 5 Drawing Sheets

METHOD OF OPERATING A COMBUSTION UNIT OF A COAL-FIRED POWER PLANT WITH A SLAG TAP FURNACE AND COMBUSTION PLANT OPERATING ACCORDING TO THE METHOD

CROSS-REFERENCE TO RELATED APPLICATION

This application is a continuation of International Application Ser. No. PCT/DE96/01721, filed Sep. 12, 1996, which designated the United States.

BACKGROUND OF THE INVENTION

Field of the Invention

The invention relates to a method of operating a combustion unit of a coal-fired power plant with a slag tap furnace. The invention also relates to a combustion unit for carrying out the method.

There are essentially two different firing techniques, namely a dry bottom furnace firing method and a slag tap furnace firing method, for operating a combustion unit of a coal-fired power plant. In the case of dry bottom furnace firing, the temperature in the combustion chamber is below the melting temperature of the ash. Almost all of the ash which forms is therefore entrained by the flue-gas stream and settles as fly ash in downstream separating systems such as, e.g. electrostatic filters. The fly ash or flue dust can be used as an additive in the construction industry. According to German Published, Non-Prosecuted Patent Application DE 31 28 903 A1, it has already been proposed to improve combustion in the case of dry bottom furnace firing by using various metal oxides as an additive.

In the case of slag tap furnace firing, the combustion temperature in the combustion chamber, which in that case is also referred to as the melting chamber, is above the melting temperature of the ash. Under normal operating conditions, that is about 1500° C. The ash melting temperature of the coal used for firing can vary widely and is essentially dependent on the content of aluminum oxide $Al_2O_3$ and silicate $SiO_2$. The majority of the ash combines into a fused mass on the bottom of the combustion chamber and is fed through outlet openings to wet slag removal equipment situated therebelow. Those are water basins in which the molten ash running out is collected and quenched. The granules that form in that process (≠i.e., melting chamber granules), which are formed essentially of aluminum silicate, have a coarse structure. The granules are a much sought-after material for road-building and are used, for example, as a bulk material as well as grit or blasting abrasive. The fly ash entrained by the flue-gas stream, up to 50% of which can be formed of combustible material (carbon and/or half-burnt hydrocarbons), is separated out in the electrostatic filters.

In order to provide particularly effective operation of the melting chamber, i.e., complete burn-up, rapid conversion of the fuel and avoidance of $NO_x$ formation, the temperature of the combustion or melting chamber and the melting temperature of the ash must be matched to one another. The composition of the coal (the ash melting temperature varies between 1300° C. and 1700° C. depending on the composition) thus determines the structure of the coal-fired power plant, e.g. the dimensioning of the combustion chamber. However, it is possible to lower the melting temperatures of the ash by adding limestone. Experience shows that the melting temperature of the ash can be lowered by about 100° C. by adding about 2% of limestone to the coal. That process offers a way of regulating the operation of the furnace.

In order to achieve a high efficiency by complete burn-up of the fuel, the procedure in modern coal-fired power plants which operate by the slag tap furnace firing method is to blow the fly ash back into the combustion chamber through a separate fly-ash return. In that case, all of the ash from the combustion or melting chamber takes the form of slag and can be disposed of in the usual way.

Although complete burn-up of the fuel is obtained by returning the fly ash, the mean dwell time of a coal or ash particle in the furnace circuit or loop is increased. The disadvantage thereof is that the maximum throughput of coal and therefore the possible power output of the power plant is limited.

SUMMARY OF THE INVENTION

It is accordingly an object of the invention to provide a method of operating a combustion unit of a coal-fired power plant and a combustion plant operating according to the method, which overcome the hereinafore-mentioned disadvantages of the heretofore-known methods and devices of this general type, in which the method operates in accordance with the slag tap furnace firing process with which a throughput of fuel and therefore a power output of the power plant can be increased, and in which the combustion unit that is suitable for carrying out the method is particularly simple.

With the foregoing and other objects in view there is provided, in accordance with the invention, a method of operating a combustion unit of a coal-fired power plant operating according to a slag tap furnace firing method, which comprises supplying a titanium-containing material in addition to coal to a melting chamber for accelerating coal burn-up; and burning the titanium-containing material together with the coal.

In accordance with another mode of the invention, the quantity of titanium, measured as titanium dioxide $TiO_2$, is present in a titanium dioxide to coal ratio of at most 3:97.

The invention starts from the observation that titanium dioxide can increase the burn-up of the coal in the combustion chamber and therefore the throughput of coal, which in turn leads to an increase in the power output of the power plant.

In order to provide effective operation of the furnace, the viscosity and melting temperature of the ash should not be changed significantly by the quantity of titanium-containing materials being added, as mentioned at the outset. In particular, the addition of titanium, which under the conditions of the melting chamber is in the form of titanium dioxide, should not promote slag-like deposits downstream of the combustion chamber, which settle on pipes and walls. It has been found that titanium dioxide lowers the melting point of the ash and the slag. A sand-like, unfused and non-adherent dust might therefore be transformed into a viscous, fluid and adherent fused mass which leads to higher cleaning costs and financial losses during the servicing of the coal-fired power plant. However, it has been found that the titanium dioxide is largely recovered in the molten ash. Titanium contents (measured as titanium dioxide) below about 3% in the total quantity of coal and titanium-containing material being supplied achieve the result of ensuring that the consistency of the slag-like deposits is unchanged, since the titanium dioxide in that case is present virtually only in the molten ash.

In accordance with a further mode of the invention, the proportion of titanium dioxide in the total quantity of coal and titanium-containing materials being added is at most 2.25%.

This discovery is surprising since even relatively small proportions of titanium dioxide in the mixture of coal and titanium-containing materials lead to considerable intensification of slagging downstream of the combustion chamber and to a slag with a fluid consistency in a coal-fired power plant with a dry bottom furnace unit. Such titanium-containing additions are therefore particularly suitable for the operation of a coal-fired power plant with a slag tap furnace.

In accordance with an added mode of the invention, more than 50% of the titanium-containing material being supplied is formed of titanium dioxide. It is thereby possible to achieve an acceleration of the coal burn-up even with a small quantity being added.

In accordance with an additional mode of the invention, a titanium dioxide to coal ratio of at least 1:99 is provided.

In accordance with yet another mode of the invention, in a power plant without fly-ash return to the melting chamber, a small proportion of the added titanium is discharged as titanium dioxide through fly ash but most of it is discharged through molten ash. Since titanium dioxide does not have a toxic effect, it is possible to make further use not only of the molten ash but also of the fly ash, in the usual manner.

In accordance with yet a further mode of the invention, the coal-fired power plant operates with a fly-ash return, and the fly ash being formed is returned to the furnace, with the result that the titanium is discharged virtually exclusively as titanium dioxide together with the molten ash being formed.

In accordance with yet an added mode of the invention, the titanium-containing material is mixed into the coal and it can then be ground therewith in a coal mill of the power plant and fed into the combustion chamber of the power plant through the burners by using a coal belt.

In accordance with yet an additional mode of the invention, the titanium-containing material is blown pneumatically into the combustion chamber, preferably through the fly-ash return.

In accordance with again another mode of the invention, the molten ash is passed on the combustion chamber bottom into wet slag removal equipment and processed into granules. It is thereby possible, without danger, to incorporate additives in the titanium-containing material added into the resulting granules, by melting.

There is no risk to the environment in the use of the granules as a construction material because the incorporated additives such as, for example, heavy metals, are bound insolubly to the granules.

In accordance with again a further mode of the invention, spent $DeNO_x$ catalysts, i.e., $DeNO_x$ catalysts which are to be disposed of, or waste products, from the titanium-processing industry, for example, are used as the titanium-containing material. This provides an inexpensive and environmentally friendly disposal route for spent $DeNO_x$ catalysts since otherwise costs are incurred for dumping or expensive reconditioning measures. It is only with certain catalysts being formed largely of titanium dioxide and containing 10% or more of molybdenum that it has been found that detectable quantities of heavy metals (particularly arsenic) can be leached out of granules produced in that way. With a $DeNO_x$ catalyst containing 4.5% molybdenum, such leaching has not been found, and the possibility of restrictions will thus arise only for catalysts with such a high molybdenum content.

The method provides an advantageous disposal route for waste products, e.g. titanium slag, from the titanium-processing industry. For example, in the Federal Republic of Germany, about 300,000 to 400,000 tons of titanium dioxide are produced every year.

With the objects of the invention in view there is also provided a combustion unit for a coal-fired power plant, comprising a melting chamber having a combustion zone for receiving coal; and a separate feed line for supplying a titanium-containing material to the combustion zone for accelerating burn-up of the coal.

In accordance with another feature of the invention, there is provided a feed for feeding the titanium-containing material to the melting chamber together with the coal as a fuel.

In accordance with a concomitant feature of the invention, there is provided a dust-filter unit disposed downstream of the melting chamber on a flue-gas side, and a fly-ash return connected to the dust-filter unit for feeding titanium-containing material to the melting chamber.

Other features which are considered as characteristic for the invention are set forth in the appended claims.

Although the invention is illustrated and described herein as embodied in a method of operating a combustion unit of a coal-fired power plant with a slag tap furnace and a combustion plant operating according to the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
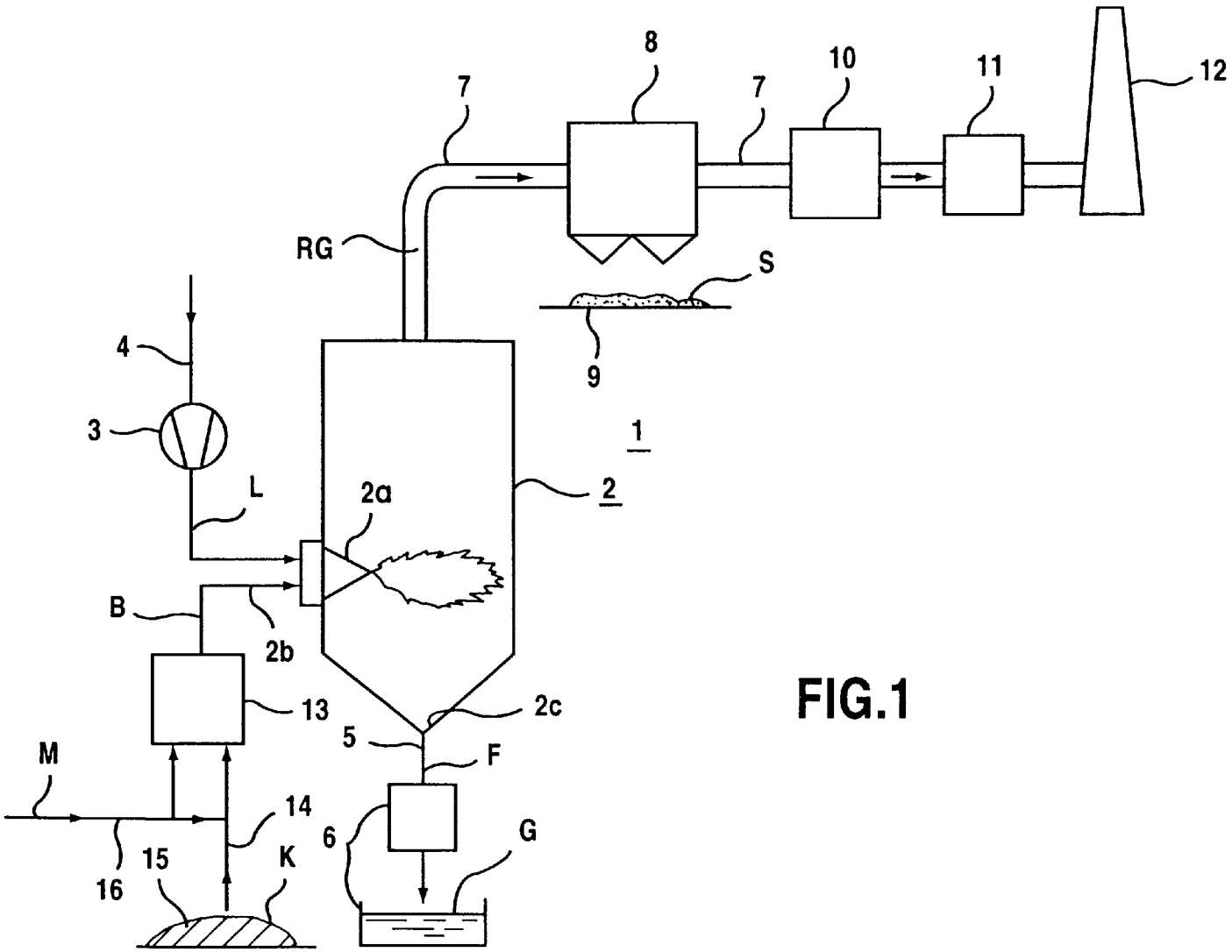
FIG. 1 is a diagrammatic and schematic representation of a combustion unit of a coal-fired power plant with a melting chamber, a coal mill, a $DeNO_x$ unit and a granulate production facility.

Referring now to the figures of the drawings in detail and first, particularly, to FIG. 1 thereof, there is seen a combustion unit 1 of a first exemplary embodiment of the invention which is part of a coal-fired power plant that is not shown in greater detail. The combustion unit 1 includes a high-temperature combustion chamber constructed as a melting chamber 2 with a combustion zone, at least one burner 2*a* and a feed 2*b*, e.g. a conveyor belt for coal K, as well as a fresh-air conduit 4 which passes through a compressor 3.

The combustion unit 1 furthermore includes a discharge line 5 for molten ash F with wet slag removal equipment 6 connected thereto. The combustion unit 1 additionally includes a flue-gas conduit 7 and a dust filter unit 8 with a fly ash collector 9, a flue-gas desulfurization unit 10 and a catalytic unit 11 for the removal of nitrogen oxides, disposed in series in the flue-gas conduit 7. The flue-gas conduit 7 opens into a chimney 12. The feed 2*b* is connected to a coal mill 13, which is connected to a feed shaft 14 of a coal storage device 15 and to a separate feed conduit 16 for the addition of titanium-containing material M. The amount of titanium-containing material M that is supplied in this case is used to adjust a burn-up acceleration of the coal K in the combustion chamber 2. During the operation of the coal-fired power plant, the coal K is conveyed from the coal storage device 15 through the feed shaft 14 to the coal mill 13. The titanium-containing material M is introduced into the coal mill 13 either directly or through the feed conduit 16 and the feed shaft 14 and is ground there as fine as dust together with the coal K. Fuel B which is prepared in this way passes through the feed 2*b* and the burner 2*a* into the combustion chamber 2. There, it is burnt with compressed air L supplied through the fresh-air conduit 4. Flue gas RG forms and flows through the flue-gas conduit 7 into the dust filter unit 8, where fly ash or flue dust S entrained by the flue gas is caught and discharged through the fly ash collector 9. The flue gas RG, which is then virtually dust-free, passes to the flue-gas desulfurization unit 10 and through the unit 11 for the removal of nitrogen oxides, generally referred to as a $DeNO_x$ unit, into the chimney 12.

The molten ash F collecting on a bottom 2*c* of the combustion chamber is fed through the discharge line 5 to the wet slag removal equipment 6 and processed into granules G.

The fly ash S which is collected on the collector 9 can be utilized as usual. The use of up to 3% of titanium-containing material M with a titanium dioxide content of more than 50% is advantageous. Additives or impurities contained in this material M such as, for example, heavy metals, are melted insolubly into the granules G that are obtained. These granules G from the melting chamber can be used in the customary manner as a construction material.

Figure 2:
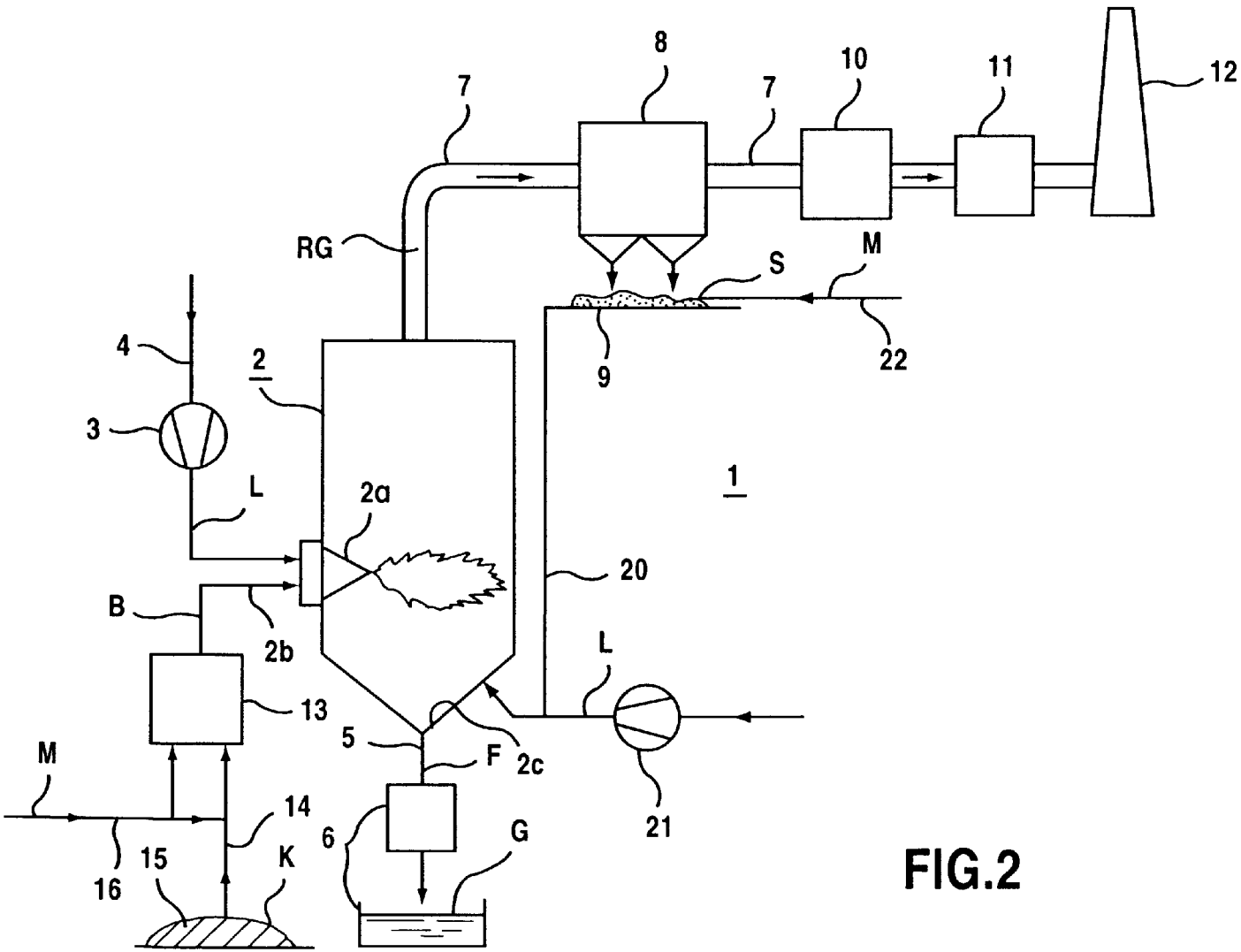
FIG. 2 is a representation of a coal-fired power plant in accordance with FIG. 1 with a fly-ash return.

In a preferred second exemplary embodiment of the invention in accordance with FIG. 2, the combustion unit 1 with the slag tap furnace has a fly-ash return 20. This fly-ash return 20 opens directly into the combustion chamber 2 of the slag tap furnace. The fly ash S which is retained in the dust filter unit 8 above the collector 9 is blown pneumatically into the combustion chamber 2 with the aid of an additional compressor 21. The titanium-containing material M which is ground as fine as dust, is mixed-in to the fly ash S through a separate feed conduit 22 and passes with the fly ash into the combustion chamber 2. Particularly effective burn-up with a simultaneous acceleration of the throughput of coal K in the power plant is achieved by the addition of the titanium-containing material M to the combustion chamber 2 of the coal-fired power plant with a slag tap furnace in combination with a fly-ash return 20. This increases the power output of the power plant.

Titanium dioxide and additives contained in the fly ash S and contaminated with heavy metals are bound insolubly in the granules G from the melting chamber which are formed. In this way, it is possible to dispose of spent $DeNO_x$ catalysts containing more than 50% of $TiO_2$ without a problem.

Test results will be explained below. In these results, parts refer to percentages by mass.

EXAMPLE 1

Spent $DeNO_x$ catalysts which are used as the titanium-containing material M, are mixed with coal K. A highly decarbonized hard coal which can be used as the coal K is rich in incombustibles and, depending on its degree of decarbonization and the proportion of volatile components, belongs to the lean coals and lies on the border between lean coals and anthracite coals. The ash from this coal has a normal melting behavior. The catalyst which is used is composed of about 75% $TiO_2$ and contains further catalytic components (about 11% $SiO_2$, about 8% $WO_3$, and about 1.8% $V_2O_5$).

Combustion tests are carried out in a combustion chamber 2 with a proportion of catalyst $M_K$ in the mixture of catalyst material and coal of 0%, 1% and 3%. The combustion chamber 2 is constructed as a laboratory combustion-chamber, with a molten ash outlet and a dry ash outlet. The composition of the ash, the influencing of the slagging behavior of the coal through the addition of spent catalyst, the influence of the proportion of catalyst $M_k$ on the slagging intensity of the heating surfaces downstream of the combustion chamber and the distribution of the catalyst material in the combustion residues are investigated. An X-ray fluorescence analysis of these combustion residues is carried out.

Figure 3:
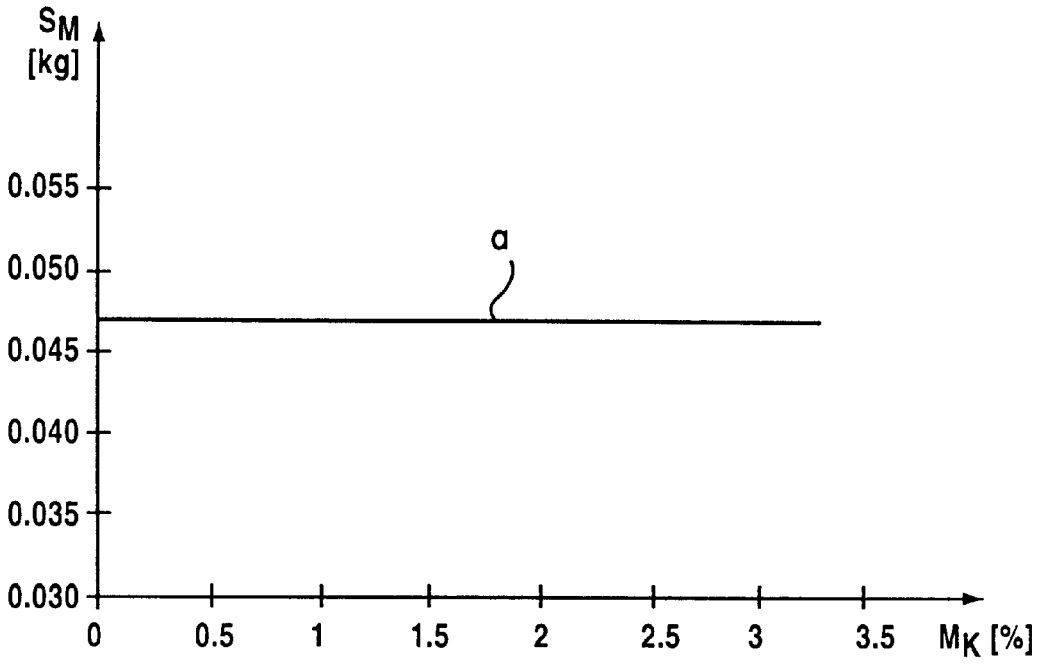
FIG. 3 is a first diagram showing a mass of fly ash, given an increasing addition of spent catalyst material.
Figure 4:
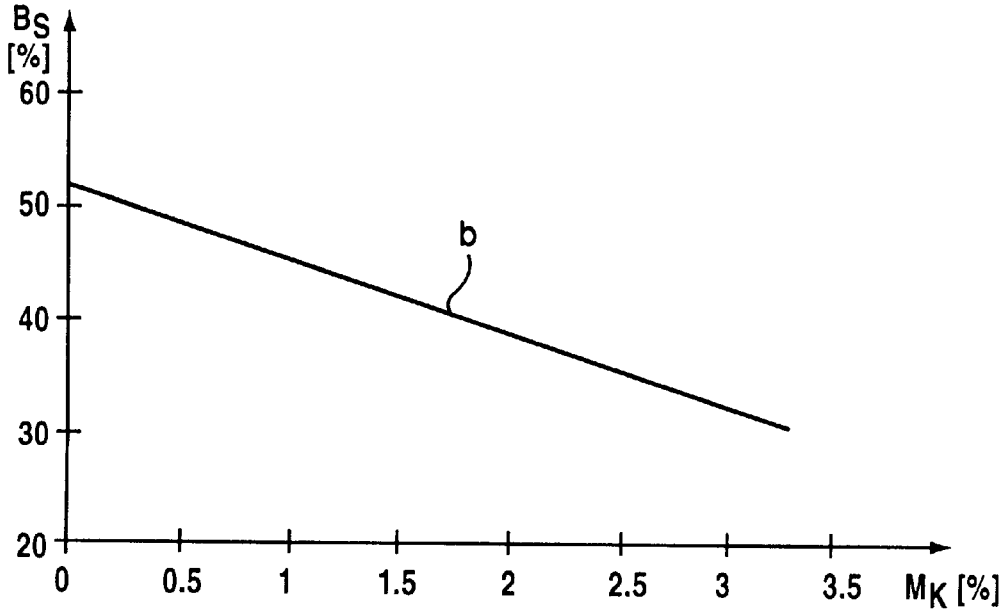
FIG. 4 is a second diagram showing a combustible component in the fly ash as a function of a proportion of catalyst in the coal mixture.

As examples, FIGS. 3 to 7 show the results of tests for the combustion chamber with a molten ash outlet. FIG. 3 shows the mass of fly ash $S_M$ being formed during combustion per kilogram of coal as a function of a proportion of catalyst $M_k$ being supplied. It is found that the mass of fly ash $S_M$ does not change up to a proportion of catalyst $M_k$ of 3% (curve a). Surprisingly, however, it is very clearly apparent that the proportion of catalyst improves the burn-up of the coal (measured by a proportion $B_s$ of combustibles in the fly ash and illustrated by a curve b in FIG. 4). When the proportion of catalyst $M_k$ in the mixture of coal and catalyst is 3%, the proportion $B_s$ of combustibles in the fly ash decreases from 50% to 30% in comparison with $M_k$=0%.

Figure 5:
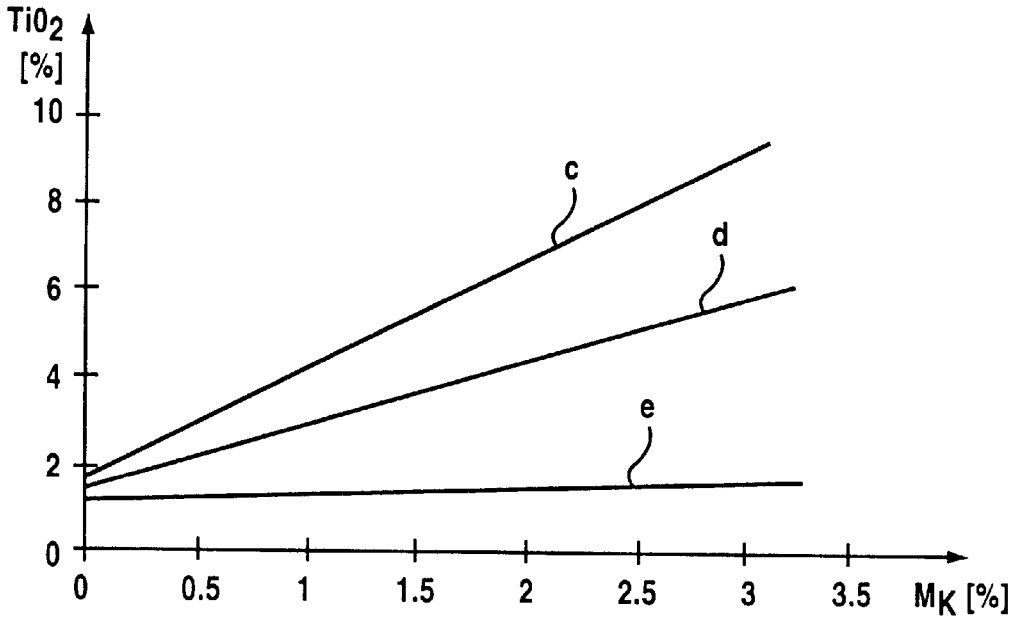
FIGS. 5–7 are third, fourth and fifth respective diagrams showing a content of catalyst components ($TiO_2$ $V_2O_5$ $WO_3$) from a $DeNO_x$ catalyst in the slag, in the fly ash and in the slag-like deposits on components downstream of the combustion chamber, in each case as a function of the proportion of catalyst in the coal mixture.
Figure 6:
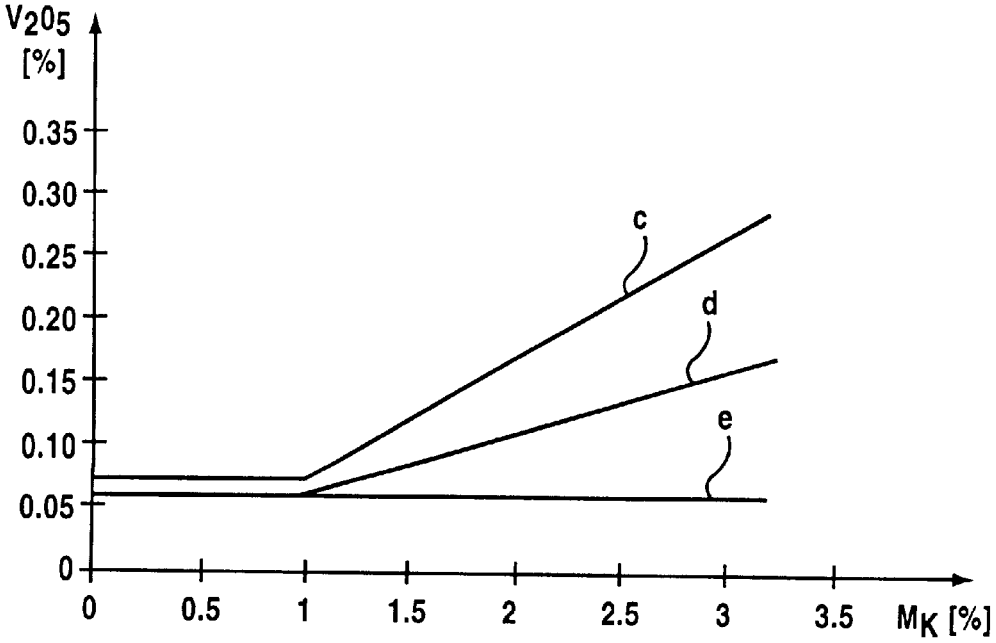
Figure 7:
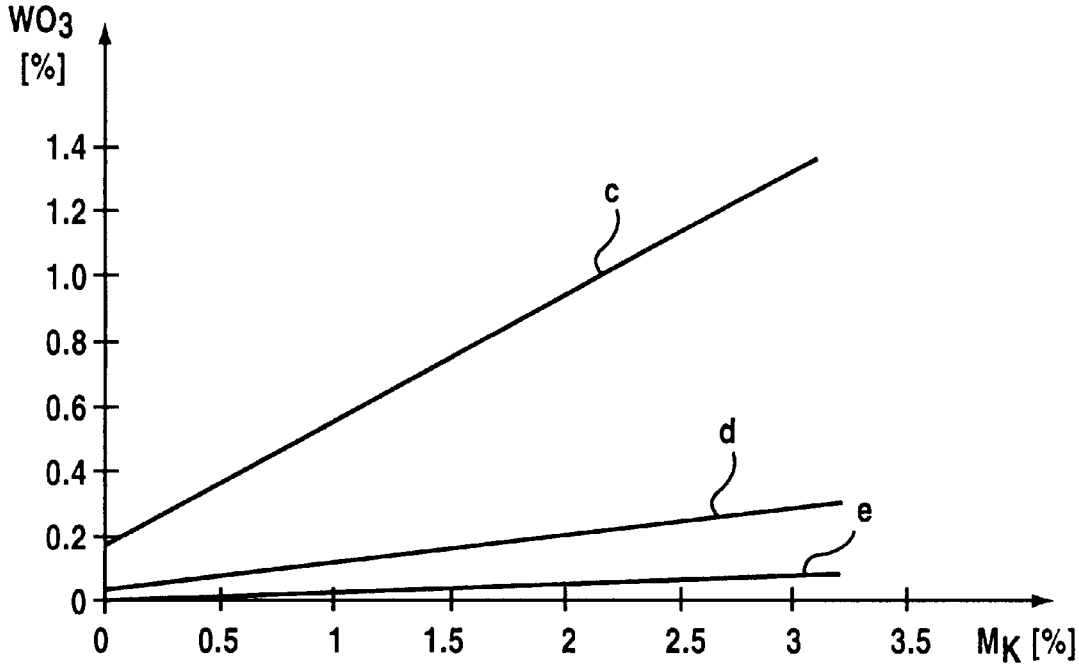

Curves c, d and e in FIGS. 5 to 7 show the percentage of active catalyst substances $TiO_2$ (FIG. 5), $V_2O_5$ (FIG. 6) and $WO_3$ (FIG. 7) in the slag or molten ash F, in the fly ash S and in slag-like deposits. A further surprising result is that the catalyst is found especially in the slag or molten ash F (curve c, FIGS. 5 to 7 ) and partially in the fly ash S (curve d, FIGS. 5 to 7 ) but virtually not at all in the slag-like deposits (curve e, FIGS. 5 to 7 ). It is seen that only the proportions of $TiO_2$ (FIG. 5), $V_2O_5$ (FIG. 6) and $WO_3$ (FIG. 7) in the slag F and in the fly ash S increase significantly as the proportion of catalyst $M_k$ in the fuel increases (0 to 3%). However, they remain virtually unchanged in the slag-like deposits downstream of the combustion chamber. No single instance of more severe slagging downstream of the combustion chamber is found in a cooling region (shown below in Table 1). In each case the small quantities of slag-like deposits downstream of the combustion chamber are soft, not melted and non-adherent. The fact that the additional proportion of catalyst of up to 3% causes no change in the slagging behavior downstream of the combustion chamber in the case of a molten ash outlet, is explained by the fact that there is virtually no catalyst in the deposits.

The tests which are carried out in the laboratory combustion chamber with a dry ash outlet (dry-bottom furnace firing) show clearly that the formation of deposits is greatly intensified as the proportion of catalyst increases (Table 1). The deposits downstream of the combustion chamber with a dry ash outlet have a hard fused structure and have a significant flow behavior even in the combustion chamber.

TABLE 1

| | | | | | | |
|---|---|---|---|---|---|---|
| Deposits downstream of | a slag tap furnace | | a dry-bottom furnace | | | |
| Intensity of formation | Very low (independent of the proportion of catalyst) | | Low (given the combustion of a pure coal) to severe (with a 3% addition of catalyst material) | | | |
| Structure | Light, not melted | | Slightly to severly melted | | | |
| | Proportion of catalyst Mk in the fuel | | | | | |
| Deposits downstream of the combustion chamber | 0% | 1% | 3% | 0% | 1% | 3% |
| Proportion of $TiO_2$ | 1.15 | 1.25 | 1.33 | 1.88 | 5.04 | 10.8 |
| Froportion of $V_2O_5$ | 0.06 | 0.06 | 0.05 | 0.09 | 0.15 | 0.35 |
| Proportion of $WO_3$ | 0.04 | 0.05 | 0.05 | 0.06 | 0.26 | 0.63 |

EXAMPLE 2

Fly ash from an electrostatic filter of a coal-fired power plant with a slag tap furnace is mixed with calcium carbonate ($CaCO_3$) in a mass ratio of 100:5. It is thereby possible to obtain a melt directly ("zero sample"). For comparison purposes, the same mixture is mixed with a spent $DeNO_x$ catalyst that is ground as fine as dust in such a way that the proportion of catalyst is 1%. The mixture is melted at 1550° C. for 20 minutes and quenched in water ("comparison example"). In each case, 5 g of the granules G which are obtained are eluted with 50 g of $H_2O$ for 24 hours and the eluate is tested for traces of vanadium V, tungsten W and arsenic As.

The quantity of active catalyst substances (V, W) that is washed out of the comparison sample is below the detection limit (<0.1 mg/l). In both samples, the arsenic content is in the same range.

We claim:

1. A method of operating a combustion unit of a coal-fired power plant operating according to a slag tap furnace firing method, which comprises:

supplying titanium dioxide in addition to coal to a melting chamber for accelerating coal burn-up in a titanium dioxide to coal mass ratio of at most 3:97, the melting chamber being a combustion chamber in the combustion unit;

burning the titanium dioxide together with the coal in the melting chamber; and generating fly ash and molten ash as a result of combustion in the melting chamber.

2. The method according to claim 1, which comprises supplying a mass proportion of titanium dioxide of at most 2.25% with respect to a total mass of coal and titanium dioxide.

3. The method according to claim 1, which comprises supplying the titanium dioxide in a material that contains more than 50% titanium dioxide.

4. The method according to claim 1, which comprises setting the titanium dioxide to coal mass ratio of at most 3:97 by using a material containing more than 50% titanium dioxide.

5. The method according to claim 1, wherein the step of supplying titanium dioxide is performed by supplying a titanium dioxide to coal mass ratio of at least 1:99.

6. The method according to claim 1, which comprises collecting fly ash formed during combustion in a dust filter unit with a fly ash collector, the dust filter unit being disposed in a flue gas conduit, and returning the fly ash to the melting chamber.

7. The method according to claim 1, which comprises mixing the titanium dioxide into the coal.

8. The method according to claim 1, which comprises pneumatically blowing the titanium dioxide into the melting chamber.

9. The method according to claim 8, which comprises pneumatically blowing the titanium dioxide into the melting chamber through a fly-ash return.

10. The method according to claim 1, which comprises processing the molten ash generated from the burning into granules in wet slag removal equipment.

11. The method according to claim 1, which comprises supplying titanium dioxide by using DeNOx catalysts.

* * * * *